US008500261B2

(12) United States Patent
Morgan et al.

(10) Patent No.: US 8,500,261 B2
(45) **Date of Patent: *Aug. 6, 2013**

(54) PRINTER UTILIZING PRESSURE CONTROL OF AIR IN SUMP

(75) Inventors: John Douglas Peter Morgan, Balmain (AU); David John Worboys, Balmain (AU); Miao Wang, Balmain (AU); Patrick John McAuliffe, Balmain (AU); Kia Silverbrook, Balmain (AU)

(73) Assignee: Zamtec Ltd, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 13/219,708

(22) Filed: Aug. 28, 2011

(65) Prior Publication Data

US 2011/0310201 A1 Dec. 22, 2011

Related U.S. Application Data

(63) Continuation of application No. 11/872,718, filed on Oct. 16, 2007, now Pat. No. 8,020,980.

(51) Int. Cl.
*B41J 2/185* (2006.01)
*B41J 2/175* (2006.01)

(52) U.S. Cl.
USPC ..... 347/90; 347/85

(58) Field of Classification Search
USPC ..... 347/84, 85, 86, 87
See application file for complete search history.

(56) References Cited

U.S. PATENT DOCUMENTS

| | | | | |
|---|---|---|---|---|
| 4,399,446 | A * | 8/1983 | McCann et al. | 347/89 |
| 4,419,678 | A | 12/1983 | Kasugayama et al. | |
| 4,476,472 | A | 10/1984 | Aiba et al. | |
| 4,494,124 | A | 1/1985 | Piatt et al. | |
| 4,555,712 | A | 11/1985 | Arway et al. | |
| 5,583,544 | A | 12/1996 | Stamer et al. | |
| 5,980,034 | A | 11/1999 | Tsai et al. | |
| 6,302,516 | B1 | 10/2001 | Brooks et al. | |
| 6,991,313 | B2 | 1/2006 | Sasa | |
| 7,597,434 | B2 * | 10/2009 | Nitta et al. | 347/89 |
| 7,798,600 | B2 | 9/2010 | Karppinen et al. | |
| 7,874,656 | B2 * | 1/2011 | Ota et al. | 347/85 |
| 8,020,980 | B2 * | 9/2011 | Morgan et al. | 347/90 |
| 2006/0132554 | A1 | 6/2006 | Ota et al. | |
| 2007/0206050 | A1 | 9/2007 | Morgan et al. | |

FOREIGN PATENT DOCUMENTS

| | | |
|---|---|---|
| EP | 0082272 | 6/1985 |
| JP | 2005-125669 | 5/2005 |

* cited by examiner

*Primary Examiner* — Anh T. N. Vo

(74) *Attorney, Agent, or Firm* — Cooley LLP

(57) ABSTRACT

An inkjet printer includes a printhead for printing onto a media substrate, the printhead defining a plurality of nozzles from which ink is expelled; an ink tank provided upstream of the printhead; a sump provided downstream of the printhead for collecting unused ink from the printhead, the sump having a lower portion for holding the unused ink and an upper portion defining a headspace of air above the unused ink; a first fluid conduit extending between the printhead and the sump for communicating the unused ink from the printhead to the sump, the first fluid conduit connecting the sump to a position in the printhead upstream of the plurality of nozzles; and a pump connected to the sump, the pump for drawing air from the headspace of the sump into atmosphere and effecting a negative pressure in the printhead upstream of the nozzles. Communication of ink from the ink tank to the printhead is effected by the negative pressure generated by the drawing of air from the headspace of the sump.

10 Claims, 2 Drawing Sheets

PRINTER UTILIZING PRESSURE CONTROL OF AIR IN SUMP

CROSS REFERENCE TO RELATED APPLICATIONS

This application is a continuation of U.S. application Ser. No. 11/872,718 filed Oct. 16, 2007, now issued U.S. Pat. No. 8,020,980, all of which is herein incorporated by reference.

FIELD OF THE INVENTION

The present invention relates to printers and in particular the fluidic architecture of inkjet printers.

CO-PENDING APPLICATIONS

The following application has been filed by the Applicant with the present application: U.S. Pat. No. 7,914,132

The disclosure of this co-pending application is incorporated herein by reference.

CROSS REFERENCES TO RELATED APPLICATIONS

Various methods, systems and apparatus relating to the present invention are disclosed in the following US patents/patent applications filed by the applicant or assignee of the present invention:

| | | | | |
|---|---|---|---|---|
| 6,276,850 | 6,520,631 | 6,158,907 | 6,539,180 | 6,270,177 |
| 6,405,055 | 6,628,430 | 6,835,135 | 6,626,529 | 6,981,769 |
| 7,125,338 | 7,125,337 | 7,136,186 | 10/920,372 | 7,145,689 |
| 7,130,075 | 7,081,974 | 7,177,055 | 7,209,257 | 6,443,555 |
| 7,161,715 | 7,154,632 | 7,158,258 | 7,148,993 | 7,075,684 |
| 10/943,905 | 10/943,906 | 10/943,904 | 10/943,903 | 10/943,902 |
| 6,966,659 | 6,988,841 | 7,077,748 | 7,255,646 | 7,070,270 |
| 7,014,307 | 7,158,809 | 7,217,048 | 11/225,172 | 11/255,942 |
| 11/329,039 | 11/329,040 | 7,271,829 | 11/442,189 | 11/474,280 |
| 11/483,061 | 11/503,078 | 11/520,735 | 11/505,858 | 11/525,850 |
| 11/583,870 | 11/592,983 | 11/592,208 | 11/601,828 | 11/635,482 |
| 11/635,526 | 10/466,440 | 7,215,441 | 11/650,545 | 11/653,241 |
| 11/653,240 | 7,056,040 | 6,942,334 | 11/706,300 | 11/740,265 |
| 11/737,720 | 11/739,056 | 11/740,204 | 11/740,223 | 11/753,557 |
| 11/750,285 | 11/758,648 | 11/778,559 | 11/834,634 | 11/838,878 |
| 11/845,669 | 6,799,853 | 7,237,896 | 6,749,301 | 10/451,722 |
| 7,137,678 | 7,252,379 | 7,144,107 | 10/503,900 | 10/503,898 |
| 10/503,897 | 7,220,068 | 7,270,410 | 7,241,005 | 7,108,437 |
| 7,140,792 | 10/503,922 | 7,224,274 | 10/503,917 | 10/503,918 |
| 10/503,925 | 10/503,927 | 10/503,928 | 10/503,929 | 10/503,885 |
| 7,195,325 | 7,229,164 | 7,150,523 | 10/503,889 | 7,154,580 |
| 6,906,778 | 7,167,158 | 7,128,269 | 6,688,528 | 6,986,613 |
| 6,641,315 | 10/503,890 | 10/503,891 | 7,150,524 | 7,155,395 |
| 6,915,140 | 6,999,206 | 6,795,651 | 6,883,910 | 7,118,481 |
| 7,136,198 | 7,092,130 | 6,786,661 | 6,808,325 | 10/920,368 |
| 10/920,284 | 7,219,990 | 10/920,283 | 6,750,901 | 6,476,863 |
| 6,788,336 | 6,322,181 | 6,597,817 | 6,227,648 | 6,727,948 |
| 6,690,419 | 10/470,947 | 6,619,654 | 6,969,145 | 6,679,582 |
| 10/470,942 | 6,568,670 | 6,866,373 | 10/102,696 | 7,008,044 |
| 6,742,871 | 6,966,628 | 6,644,781 | 6,969,143 | 6,767,076 |
| 6,834,933 | 6,692,113 | 6,913,344 | 6,727,951 | 7,128,395 |
| 7,036,911 | 7,032,995 | 6,969,151 | 6,955,424 | 6,969,162 |
| 10/919,249 | 6,942,315-B2 | 11/006,577 | 7,234,797 | 6,986,563 |
| 11/063,577 | 11/045,442 | 11/124,044 | 11/124,284 | 7,077,330 |
| 6,196,541 | 11/149,389 | 11/185,725 | 7,226,144 | 11/202,344 |
| 7,267,428 | 11/248,423 | 11/248,422 | 7,093,929 | 11/282,769 |
| 11/330,060 | 11/442,111 | 11/472,406 | 11/499,806 | 11/499,710 |
| 6,195,150 | 11/749,156 | 11/782,588 | 11/854,435 | 11/853,817 |
| 6,362,868 | 6,831,681 | 6,431,669 | 6,362,869 | 6,472,052 |
| 6,356,715 | 6,894,694 | 6,636,216 | 6,366,693 | 6,329,990 |
| 6,459,495 | 6,137,500 | 6,690,416 | 7,050,143 | 6,398,328 |
| 7,110,024 | 6,431,704 | 6,879,341 | 6,415,054 | 6,665,454 |
| 6,542,645 | 6,486,886 | 6,381,361 | 6,317,192 | 6,850,274 |

-continued

| | | | | |
|---|---|---|---|---|
| 09/113,054 | 6,646,757 | 6,624,848 | 6,357,135 | 6,271,931 |
| 6,353,772 | 6,106,147 | 6,665,008 | 6,304,291 | 6,305,770 |
| 6,289,262 | 6,315,200 | 6,217,165 | 6,496,654 | 6,859,225 |
| 6,924,835 | 6,647,369 | 6,943,830 | 09/693,317 | 7,021,745 |
| 6,712,453 | 6,460,971 | 6,428,147 | 6,416,170 | 6,402,300 |
| 6,464,340 | 6,612,687 | 6,412,912 | 6,447,099 | 6,837,567 |
| 6,505,913 | 7,128,845 | 6,733,684 | 7,249,108 | 6,566,858 |
| 6,331,946 | 6,246,970 | 6,442,525 | 09/517,384 | 09/505,951 |
| 6,374,354 | 7,246,098 | 6,816,968 | 6,757,832 | 6,334,190 |
| 6,745,331 | 7,249,109 | 10/203,559 | 7,197,642 | 7,093,139 |
| 10/636,263 | 10/636,283 | 10/866,608 | 7,210,038 | 10/902,833 |
| 10/940,653 | 10/942,858 | 11/706,329 | 11/757,385 | 11/758,642 |
| 7,119,836 | 10/322,698 | 10/642,331 | 10/636,285 | 7,170,652 |
| 6,967,750 | 6,995,876 | 7,099,051 | 7,172,191 | 7,243,916 |
| 7,222,845 | 11/239,232 | 11/055,276 | 7,063,940 | 11/107,942 |
| 7,193,734 | 7,086,724 | 7,090,337 | 11/185,952 | 7,140,717 |
| 11/190,902 | 11/209,711 | 7,256,824 | 7,140,726 | 7,156,512 |
| 7,186,499 | 11/478,585 | 11/525,862 | 11/540,574 | 11/583,875 |
| 11/592,181 | 6,750,944 | 11/599,336 | 11/650,548 | 11/744,183 |
| 11/758,646 | 11/778,561 | 11/839,532 | 11/838,874 | 11/853,021 |
| 11/869,710 | 11/868,531 | 10/636,225 | 10/510,094 | 6,985,207 |
| 6,773,874 | 6,650,836 | 10/666,495 | 10/636,224 | 7,250,975 |
| 10/636,214 | 6,880,929 | 7,236,188 | 7,236,187 | 7,155,394 |
| 10/636,219 | 10/636,223 | 7,055,927 | 6,986,562 | 7,052,103 |
| 10/656,469 | 10/656,281 | 10/656,791 | 10/666,124 | 10/683,217 |
| 10/683,197 | 7,095,533 | 6,914,686 | 6,896,252 | 6,820,871 |
| 6,834,851 | 6,848,686 | 6,830,246 | 6,851,671 | 10/729,098 |
| 7,092,011 | 7,187,404 | 10/729,159 | 10/753,458 | 6,878,299 |
| 6,929,348 | 6,921,154 | 10/780,625 | 10/804,042 | 6,913,346 |
| 10/831,238 | 10/831,237 | 10/831,239 | 10/831,240 | 10/831,241 |
| 10/831,234 | 10/831,233 | 7,246,897 | 7,077,515 | 10/831,235 |
| 10/853,336 | 10/853,659 | 10/853,681 | 6,913,875 | 7,021,758 |
| 7,033,017 | 7,161,709 | 7,099,033 | 7,147,294 | 7,156,494 |
| 11/012,024 | 11/011,925 | 7,032,998 | 7,044,585 | 11/007,250 |
| 6,994,424 | 11/006,787 | 7,258,435 | 7,097,263 | 7,001,012 |
| 7,004,568 | 7,040,738 | 7,188,933 | 7,027,080 | 7,025,446 |
| 6,991,321 | 7,131,715 | 7,261,392 | 7,207,647 | 7,182,435 |
| 7,097,285 | 11/228,410 | 7,097,284 | 7,083,264 | 7,147,304 |
| 7,232,203 | 7,156,498 | 7,201,471 | 11/501,772 | 11/503,084 |
| 11/513,073 | 7,210,764 | 11/635,524 | 11/706,379 | 11/730,386 |
| 11/730,784 | 11/753,568 | 11/782,591 | 11/859,783 | 6,710,457 |
| 6,775,906 | 6,507,099 | 7,221,043 | 7,107,674 | 7,154,172 |
| 11/442,400 | 7,247,941 | 11/736,540 | 11/758,644 | 6,530,339 |
| 6,631,897 | 6,851,667 | 6,830,243 | 6,860,479 | 6,997,452 |
| 7,000,913 | 7,204,482 | 11/212,759 | 11/281,679 | 11/730,409 |
| 6,238,044 | 6,425,661 | 11/003,786 | 7,258,417 | 11/003,418 |
| 11/003,334 | 7,270,395 | 11/003,404 | 11/003,419 | 11/003,700 |
| 7,255,419 | 11/003,618 | 7,229,148 | 7,258,416 | 7,273,263 |
| 7,270,393 | 6,984,017 | 11/003,699 | 11/071,473 | 7,156,497 |
| 11/601,670 | 11/748,482 | 11/778,563 | 11/779,851 | 11/778,574 |
| 11/853,816 | 11/853,814 | 11/853,786 | 11/856,694 | 11/003,463 |
| 11/003,701 | 11/003,683 | 11/003,614 | 11/003,702 | 11/003,684 |
| 7,246,875 | 11/003,617 | 11/764,760 | 11/853,777 | 11/293,800 |
| 11/293,802 | 11/293,801 | 11/293,808 | 11/293,809 | 11/482,975 |
| 11/482,970 | 11/482,968 | 11/482,972 | 11/482,971 | 11/482,969 |
| 6,431,777 | 6,334,664 | 6,447,113 | 7,239,407 | 6,398,359 |
| 6,652,089 | 6,652,090 | 7,057,759 | 6,631,986 | 7,187,470 |
| 11/315,356 | 11/501,775 | 11/744,210 | 11/859,784 | 6,471,331 |
| 6,676,250 | 6,347,864 | 6,439,704 | 6,425,700 | 6,588,952 |
| 6,626,515 | 6,722,758 | 6,871,937 | 11/060,803 | 11/097,266 |
| 11/097,267 | 11/685,084 | 11/685,086 | 11/685,090 | 11/740,925 |
| 11/763,444 | 11/763,443 | 7,249,942 | 7,206,654 | 7,162,324 |
| 7,162,325 | 7,231,275 | 7,146,236 | 10/753,475 | 10/753,499 |
| 6,997,698 | 7,220,112 | 7,231,276 | 10/753,440 | 7,220,115 |
| 7,195,475 | 7,144,242 | 11/499,746 | 11/501,774 | 11/525,858 |
| 11/545,501 | 11/599,335 | 11/706,380 | 11/736,545 | 11/736,554 |
| 11/739,047 | 11/749,159 | 11/739,073 | 11/775,160 | 11/853,755 |
| TEST | 6,786,420 | 6,827,282 | 6,948,661 | 7,073,713 |
| 10/983,060 | 7,093,762 | 7,083,108 | 7,222,799 | 7,201,319 |
| 11/442,103 | 11/739,071 | 11/518,238 | 11/518,280 | 11/518,244 |
| 11/518,243 | 11/518,242 | 7,032,899 | 6,854,724 | 11/084,237 |
| 11/084,240 | 11/084,238 | 11/357,296 | 11/357,298 | 11/357,297 |
| 6,350,023 | 6,318,849 | 6,592,207 | 6,439,699 | 6,312,114 |
| 11/246,676 | 11/246,677 | 11/246,678 | 11/246,679 | 11/246,680 |
| 11/246,681 | 11/246,714 | 11/246,713 | 11/246,689 | 11/246,671 |
| 11/246,670 | 11/246,669 | 11/246,704 | 11/246,710 | 11/246,688 |
| 11/246,716 | 11/246,715 | 11/246,707 | 11/246,706 | 11/246,705 |
| 11/246,708 | 11/246,693 | 11/246,692 | 11/246,696 | 11/246,695 |
| 11/246,694 | 11/482,958 | 11/482,955 | 11/482,962 | 11/482,963 |
| 11/482,956 | 11/482,954 | 11/482,974 | 11/482,957 | 11/482,987 |

-continued

| | | | | |
|---|---|---|---|---|
| 11/482,959 | 11/482,960 | 11/482,961 | 11/482,964 | 11/482,965 |
| 11/482,976 | 11/482,973 | 11/495,815 | 11/495,816 | 11/495,817 |
| 10/803,074 | 10/803,073 | 7,040,823 | 10/803,076 | 10/803,077 |
| 10/803,078 | 10/803,079 | 10/922,971 | 10/922,970 | 10/922,836 |
| 10/922,842 | 10/922,848 | 10/922,843 | 7,125,185 | 7,229,226 |
| 11/513,386 | 11/753,559 | 10/815,621 | 7,243,835 | 10/815,630 |
| 10/815,637 | 10/815,638 | 7,251,050 | 10/815,642 | 7,097,094 |
| 7,137,549 | 10/815,618 | 7,156,292 | 11/738,974 | 10/815,635 |
| 10/815,647 | 10/815,634 | 7,137,566 | 7,131,596 | 7,128,265 |
| 7,207,485 | 7,197,374 | 7,175,089 | 10/815,617 | 10/815,620 |
| 7,178,719 | 10/815,613 | 7,207,483 | 10/815,619 | 7,270,266 |
| 10/815,614 | 11/446,240 | 11/488,162 | 11/488,163 | 11/488,164 |
| 11/488,167 | 11/488,168 | 11/488,165 | 11/488,166 | 7,267,273 |
| 11/834,628 | 11/839,497 | 10/815,636 | 7,128,270 | 11/041,650 |
| 11/041,651 | 11/041,652 | 11/041,649 | 11/041,610 | 11/863,253 |
| 11/863,255 | 11/863,257 | 11/863,258 | 11/863,262 | 11/041,609 |
| 11/041,626 | 11/041,627 | 11/041,624 | 11/041,625 | 11/863,268 |
| 11/863,269 | 11/863,270 | 11/863,271 | 11/863,273 | 76/584,733 |
| 11/041,556 | 11/041,580 | 11/041,723 | 11/041,698 | 11/041,648 |
| 11/863,263 | 11/863,264 | 11/863,265 | 11/863,266 | 11/863,267 |
| 10/815,609 | 7,150,398 | 7,159,777 | 10/815,610 | 7,188,769 |
| 7,097,106 | 7,070,110 | 7,243,849 | 11/442,381 | 11/480,957 |
| 11/764,694 | 6,227,652 | 6,213,588 | 6,213,589 | 6,231,163 |
| 6,247,795 | 6,394,581 | 6,244,691 | 6,257,704 | 6,416,168 |
| 6,220,694 | 6,257,705 | 6,247,794 | 6,234,610 | 6,247,793 |
| 6,264,306 | 6,241,342 | 6,247,792 | 6,264,307 | 6,254,220 |
| 6,234,611 | 6,302,528 | 6,283,582 | 6,239,821 | 6,338,547 |
| 6,247,796 | 6,557,977 | 6,390,603 | 6,362,843 | 6,293,653 |
| 6,312,107 | 6,227,653 | 6,234,609 | 6,238,040 | 6,188,415 |
| 6,227,654 | 6,209,989 | 6,247,791 | 6,336,710 | 6,217,153 |
| 6,416,167 | 6,243,113 | 6,283,581 | 6,247,790 | 6,260,953 |
| 6,267,469 | 6,588,882 | 6,742,873 | 6,918,655 | 6,547,371 |
| 6,938,989 | 6,598,964 | 6,923,526 | 6,273,544 | 6,309,048 |
| 6,420,196 | 6,443,558 | 6,439,689 | 6,378,989 | 6,848,181 |
| 6,634,735 | 6,299,289 | 6,299,290 | 6,425,654 | 6,902,255 |
| 6,623,101 | 6,406,129 | 6,505,916 | 6,457,809 | 6,550,895 |
| 6,457,812 | 7,152,962 | 6,428,133 | 7,216,956 | 7,080,895 |
| 11/144,844 | 7,182,437 | 11/599,341 | 11/635,533 | 11/607,976 |
| 11/607,975 | 11/607,999 | 11/607,980 | 11/607,979 | 11/607,978 |
| 11/735,961 | 11/685,074 | 11/696,126 | 11/696,144 | 11/696,650 |
| 11/763,446 | 6,224,780 | 6,235,212 | 6,280,643 | 6,284,147 |
| 6,214,244 | 6,071,750 | 6,267,905 | 6,251,298 | 6,258,285 |
| 6,225,138 | 6,241,904 | 6,299,786 | 6,866,789 | 6,231,773 |
| 6,190,931 | 6,248,249 | 6,290,862 | 6,241,906 | 6,565,762 |
| 6,241,905 | 6,451,216 | 6,231,772 | 6,274,056 | 6,290,861 |
| 6,248,248 | 6,306,671 | 6,331,258 | 6,110,754 | 6,294,101 |
| 6,416,679 | 6,264,849 | 6,254,793 | 6,245,246 | 6,855,264 |
| 6,235,211 | 6,491,833 | 6,264,850 | 6,258,284 | 6,312,615 |
| 6,228,668 | 6,180,427 | 6,171,875 | 6,267,904 | 6,245,247 |
| 6,315,914 | 7,169,316 | 6,526,658 | 7,210,767 | 11/056,146 |
| 11/635,523 | 6,665,094 | 6,450,605 | 6,512,596 | 6,654,144 |
| 7,125,090 | 6,687,022 | 7,072,076 | 7,092,125 | 7,215,443 |
| 7,136,195 | 7,077,494 | 6,877,834 | 6,969,139 | 10/636,227 |
| 10/636,265 | 6,912,067 | 7,277,205 | 7,154,637 | 10/636,230 |
| 7,070,251 | 6,851,782 | 10/636,211 | 10/636,247 | 6,843,545 |
| 7,079,286 | 7,064,867 | 7,065,247 | 7,027,177 | 7,218,415 |
| 7,064,873 | 6,954,276 | 7,061,644 | 7,092,127 | 7,059,695 |
| 10/990,382 | 7,177,052 | 7,270,394 | 11/124,231 | 7,188,921 |
| 7,187,469 | 7,196,820 | 11/281,445 | 11/329,041 | 7,251,051 |
| 7,245,399 | 11/524,911 | 11/640,267 | 11/706,297 | 11/730,387 |
| 11/737,142 | 11/764,729 | 11/834,637 | 11/853,019 | 11/863,239 |
| 11/305,274 | 11/305,273 | 11/305,275 | 11/305,152 | 11/305,158 |
| 11/305,008 | 6,231,148 | 6,293,658 | 6,614,560 | 6,238,033 |
| 6,312,070 | 6,238,111 | 6,378,970 | 6,196,739 | 6,270,182 |
| 6,152,619 | 7,006,143 | 6,876,394 | 6,738,096 | 6,970,186 |
| 6,287,028 | 6,412,993 | 11/033,145 | 11/102,845 | 11/102,861 |
| 11/248,421 | 11/672,878 | 7,204,941 | 10/815,624 | 10/815,628 |
| 11/845,672 | 7,278,727 | 10/913,373 | 10/913,374 | 10/913,372 |
| 7,138,391 | 7,153,956 | 10/913,380 | 10/913,379 | 10/913,376 |
| 7,122,076 | 7,148,345 | 11/172,816 | 11/172,815 | 11/172,814 |
| 11/482,990 | 11/482,986 | 11/482,985 | 11/454,899 | 11/583,942 |
| 11/592,990 | 11/849,360 | 11/831,961 | 11/831,962 | 11/831,963 |
| 60/951,700 | 11/832,629 | 11/832,637 | 60/971,535 | 10/407,212 |
| 7,252,366 | 10/683,064 | 10/683,041 | 7,275,811 | 10/884,889 |
| 10/922,890 | 10/922,875 | 10/922,885 | 10/922,889 | 10/922,884 |
| 10/922,879 | 10/922,887 | 10/922,888 | 10/922,874 | 7,234,795 |
| 10/922,871 | 10/922,880 | 10/922,881 | 10/922,882 | 10/922,883 |
| 10/922,878 | 10/922,872 | 10/922,876 | 10/922,886 | 10/922,877 |
| 7,147,792 | 7,175,774 | 11/159,193 | 11/491,378 | 11/766,713 |
| 11/841,647 | 11/482,980 | 11/563,684 | 11/482,967 | 11/482,966 |

-continued

| | | | | |
|---|---|---|---|---|
| 11/482,988 | 11/482,989 | 11/293,832 | 11/293,838 | 11/293,825 |
| 11/293,841 | 11/293,799 | 11/293,796 | 11/293,797 | 11/293,798 |
| 11/124,158 | 11/124,196 | 11/124,199 | 11/124,162 | 11/124,202 |
| 11/124,197 | 11/124,154 | 11/124,198 | 11/124,153 | 11/124,151 |
| 11/124,160 | 11/124,192 | 11/124,175 | 11/124,163 | 11/124,149 |
| 11/124,152 | 11/124,173 | 11/124,155 | 7,236,271 | 11/124,174 |
| 11/124,194 | 11/124,164 | 11/124,200 | 11/124,195 | 11/124,166 |
| 11/124,150 | 11/124,172 | 11/124,165 | 11/124,186 | 11/124,185 |
| 11/124,184 | 11/124,182 | 11/124,201 | 11/124,171 | 11/124,181 |
| 11/124,161 | 11/124,156 | 11/124,191 | 11/124,159 | 11/124,176 |
| 11/124,188 | 11/124,170 | 11/124,187 | 11/124,189 | 11/124,190 |
| 11/124,180 | 11/124,193 | 11/124,183 | 11/124,178 | 11/124,177 |
| 11/124,148 | 11/124,168 | 11/124,167 | 11/124,179 | 11/124,169 |
| 11/187,976 | 11/188,011 | 11/188,014 | 11/482,979 | 11/735,490 |
| 11/853,018 | 11/228,540 | 11/228,500 | 11/228,501 | 11/228,530 |
| 11/228,490 | 11/228,531 | 11/228,504 | 11/228,533 | 11/228,502 |
| 11/228,507 | 11/228,482 | 11/228,505 | 11/228,497 | 11/228,487 |
| 11/228,529 | 11/228,484 | 11/228,489 | 11/228,518 | 11/228,536 |
| 11/228,496 | 11/228,488 | 11/228,506 | 11/228,516 | 11/228,526 |
| 11/228,539 | 11/228,538 | 11/228,524 | 11/228,523 | 11/228,519 |
| 11/228,528 | 11/228,527 | 11/228,525 | 11/228,520 | 11/228,498 |
| 11/228,511 | 11/228,522 | 111/228,515 | 11/228,537 | 11/228,534 |
| 11/228,491 | 11/228,499 | 11/228,509 | 11/228,492 | 11/228,493 |
| 11/228,510 | 11/228,508 | 11/228,512 | 11/228,514 | 11/228,494 |
| 11/228,495 | 11/228,486 | 11/228,481 | 11/228,477 | 11/228,485 |
| 11/228,483 | 11/228,521 | 11/228,517 | 11/228,532 | 11/228,513 |
| 11/228,503 | 11/228,480 | 11/228,535 | 11/228,478 | 11/228,479 |
| 6,238,115 | 6,386,535 | 6,398,344 | 6,612,240 | 6,752,549 |
| 6,805,049 | 6,971,313 | 6,899,480 | 6,860,664 | 6,925,935 |
| 6,966,636 | 7,024,995 | 10/636,245 | 6,926,455 | 7,056,038 |
| 6,869,172 | 7,021,843 | 6,988,845 | 6,964,533 | 6,981,809 |
| 11/060,804 | 7,258,067 | 11/155,544 | 7,222,941 | 11/206,805 |
| 11/281,421 | 7,249,904 | 11/737,726 | 11/772,240 | 11/863,246 |
| 11/863,145 | 11/865,650 | 6,087,638 | 6,340,222 | 6,041,600 |
| 6,299,300 | 6,067,797 | 6,286,935 | 6,044,646 | 6,382,769 |
| 10/868,866 | 6,787,051 | 6,938,990 | 11/242,916 | 11/242,917 |
| 11/144,799 | 11/198,235 | 11/861,282 | 11/861,284 | 11/766,052 |
| 7,152,972 | 11/592,996 | D529952 | 6,390,605 | 6,322,195 |
| 6,612,110 | 6,480,089 | 6,460,778 | 6,305,788 | 6,426,014 |
| 6,364,453 | 6,457,795 | 6,315,399 | 6,338,548 | 7,040,736 |
| 6,938,992 | 6,994,425 | 6,863,379 | 6,540,319 | 6,994,421 |
| 6,984,019 | 7,008,043 | 6,997,544 | 6,328,431 | 6,991,310 |
| 10/965,772 | 7,140,723 | 6,328,425 | 6,982,184 | 7,267,423 |
| 7,134,741 | 7,066,577 | 7,152,945 | 11/038,200 | 7,021,744 |
| 6,991,320 | 7,155,911 | 11/107,799 | 6,595,624 | 7,152,943 |
| 7,125,103 | 11/209,709 | 11/228,407 | 11/273,271 | 7,229,151 |
| 11/330,058 | 7,237,873 | 11/329,163 | 11/442,180 | 11/450,431 |
| 7,213,907 | 6,417,757 | 11/482,951 | 11/545,566 | 11/583,826 |
| 11/604,315 | 11/604,323 | 11/643,845 | 11/706,950 | 11/730,399 |
| 11/749,121 | 11/753,549 | 11/834,630 | 7,095,309 | 6,854,825 |
| 6,623,106 | 6,672,707 | 6,575,561 | 6,817,700 | 6,588,885 |
| 7,075,677 | 6,428,139 | 6,575,549 | 6,846,692 | 6,425,971 |
| 7,063,993 | 6,383,833 | 6,955,414 | 6,412,908 | 6,746,105 |
| 6,953,236 | 6,412,904 | 7,128,388 | 6,398,343 | 6,652,071 |
| 6,793,323 | 6,659,590 | 6,676,245 | 7,201,460 | 6,464,332 |
| 6,659,593 | 6,478,406 | 6,978,613 | 6,439,693 | 6,502,306 |
| 6,966,111 | 6,863,369 | 6,428,142 | 6,874,868 | 6,390,591 |
| 6,799,828 | 6,896,358 | 7,018,016 | 10/296,534 | 6,328,417 |
| 6,322,194 | 6,382,779 | 6,629,745 | 6,565,193 | 6,609,786 |
| 6,609,787 | 6,439,908 | 6,684,503 | 6,843,551 | 6,764,166 |
| 6,561,617 | 10/510,092 | 6,557,970 | 6,546,628 | 10/510,098 |
| 6,652,074 | 6,820,968 | 7,175,260 | 6,682,174 | 10/510,207 |
| 6,648,453 | 6,834,932 | 6,682,176 | 6,998,062 | 6,767,077 |
| 10/534,830 | 6,755,509 | 10/534,813 | 6,692,108 | 10/534,811 |
| 6,672,709 | 10/534,823 | 7,086,718 | 10/534,881 | 6,672,710 |
| 10/534,812 | 6,669,334 | 10/534,804 | 7,152,958 | 10/534,817 |
| 6,824,246 | 7,264,336 | 6,669,333 | 10/534,815 | 6,820,967 |
| 10/534,883 | 6,736,489 | 7,264,335 | 6,719,406 | 7,222,943 |
| 7,188,419 | 7,168,166 | 6,974,209 | 7,086,719 | 6,974,210 |
| 7,195,338 | 7,252,775 | 7,101,025 | 11/474,281 | 11/485,258 |
| 11/706,304 | 11/706,324 | 11/706,326 | 11/706,321 | 11/772,239 |
| 11/782,598 | 11/829,941 | 11/852,991 | 11/852,986 | 11/763,440 |
| 11/763,442 | 11/246,687 | 11/246,718 | 11/246,685 | 11/246,686 |
| 11/246,703 | 11/246,691 | 11/246,711 | 11/246,690 | 11/246,712 |
| 11/246,717 | 11/246,709 | 11/246,700 | 11/246,701 | 11/246,702 |
| 11/246,668 | 11/246,697 | 11/246,698 | 11/246,699 | 11/246,675 |
| 11/246,674 | 11/246,667 | 11/829,957 | 11/829,960 | 11/829,961 |
| 11/829,962 | 11/829,963 | 11/829,966 | 11/829,967 | 11/829,968 |
| 11/829,969 | 7,156,508 | 7,159,972 | 7,083,271 | 7,165,834 |
| 7,080,894 | 7,201,469 | 7,090,336 | 7,156,489 | 10/760,233 |

-continued

| | | | | |
|---|---|---|---|---|
| 10/760,246 | 7,083,257 | 7,258,422 | 7,255,423 | 7,219,980 |
| 10/760,253 | 10/760,255 | 10/760,209 | 7,118,192 | 10/760,194 |
| 10/760,238 | 7,077,505 | 7,198,354 | 7,077,504 | 10/760,189 |
| 7,198,355 | 10/760,232 | 10/760,231 | 7,152,959 | 7,213,906 |
| 7,178,901 | 7,222,938 | 7,108,353 | 7,104,629 | 11/446,227 |
| 11/454,904 | 11/472,345 | 11/474,273 | 7,261,401 | 11/474,279 |
| 11/482,939 | 11/482,950 | 11/499,709 | 11/592,984 | 11/601,668 |
| 11/603,824 | 11/601,756 | 11/601,672 | 11/650,546 | 11/653,253 |
| 11/706,328 | 11/706,299 | 11/706,965 | 11/737,080 | 11/737,041 |
| 11/778,062 | 11/778,566 | 11/782,593 | 11/246,684 | 11/246,672 |
| 11/246,673 | 11/246,683 | 11/246,682 | 60/939,086 | 11/860,538 |
| 11/860,539 | 11/860,540 | 11/860,541 | 11/860,542 | 7,246,886 |
| 7,128,400 | 7,108,355 | 6,991,322 | 10/728,790 | 7,118,197 |
| 10/728,784 | 10/728,783 | 7,077,493 | 6,962,402 | 10/728,803 |
| 7,147,308 | 10/728,779 | 7,118,198 | 7,168,790 | 7,172,270 |
| 7,229,155 | 6,830,318 | 7,195,342 | 7,175,261 | 10/773,183 |
| 7,108,356 | 7,118,202 | 10/773,186 | 7,134,744 | 10/773,185 |
| 7,134,743 | 7,182,439 | 7,210,768 | 10/773,187 | 7,134,745 |
| 7,156,484 | 7,118,201 | 7,111,926 | 10/773,184 | 7,018,021 |
| 11/060,751 | 11/060,805 | 11/188,017 | 7,128,402 | 11/298,774 |
| 11/329,157 | 11/490,041 | 11/501,767 | 11/499,736 | 7,246,885 |
| 7,229,156 | 11/505,846 | 11/505,857 | 11/505,856 | 11/524,908 |
| 11/524,938 | 7,258,427 | 11/524,912 | 11/592,999 | 11/592,995 |
| 11/603,825 | 11/649,773 | 11/650,549 | 11/653,237 | 11/706,378 |
| 11/706,962 | 11/749,118 | 11/754,937 | 11/749,120 | 11/744,885 |
| 11/779,850 | 11/765,439 | 11/842,950 | 11/839,539 | 11/097,308 |
| 11/097,309 | 7,246,876 | 11/097,299 | 11/097,310 | 11/097,213 |
| 11/210,687 | 11/097,212 | 7,147,306 | 7,261,394 | 11/764,806 |
| 11/782,595 | 11/482,953 | 11/482,977 | 11/544,778 | 11/544,779 |
| 11/764,808 | 11/756,624 | 11/756,625 | 11/756,626 | 11/756,627 |
| 11/756,628 | 11/756,629 | 11/756,630 | 11/756,631 | 7,156,289 |
| 7,178,718 | 7,225,979 | 11/712,434 | 11/084,796 | 11/084,742 |
| 11/084,806 | 09/575,197 | 09/575,197 | 7,079,712 | 7,079,712 |
| 6,825,945 | 6,825,945 | 09/575,165 | 09/575,165 | 6,813,039 |
| 6,813,039 | 7,190,474 | 6,987,506 | 6,987,506 | 6,824,044 |
| 7,038,797 | 7,038,797 | 6,980,318 | 6,980,318 | 6,816,274 |
| 6,816,274 | 7,102,772 | 7,102,772 | 09/575,186 | 09/575,186 |
| 6,681,045 | 6,681,045 | 6,678,499 | 6,679,420 | 6,963,845 |
| 6,976,220 | 6,728,000 | 6,728,000 | 7,110,126 | 7,173,722 |
| 7,173,722 | 6,976,035 | 6,813,558 | 6,766,942 | 6,965,454 |
| 6,995,859 | 7,088,459 | 7,088,459 | 6,720,985 | 09/609,303 |
| 6,922,779 | 6,978,019 | 6,847,883 | 7,131,058 | 09/721,895 |
| 09/607,843 | 09/693,690 | 6,959,298 | 6,973,450 | 7,150,404 |
| 6,965,882 | 7,233,924 | 09/575,181 | 09/575,181 | 09/722,174 |
| 7,175,079 | 7,162,259 | 6,718,061 | 10/291,523 | 10/291,471 |
| 7,012,710 | 6,825,956 | 10/291,481 | 7,222,098 | 10/291,825 |
| 7,263,508 | 7,031,010 | 6,972,864 | 6,862,105 | 7,009,738 |
| 6,989,911 | 6,982,807 | 10/291,576 | 6,829,387 | 6,714,678 |
| 6,644,545 | 6,609,653 | 6,651,879 | 10/291,555 | 10/291,510 |
| 10/291,592 | 10/291,542 | 7,044,363 | 7,004,390 | 6,867,880 |
| 7,034,953 | 6,987,581 | 7,216,224 | 10/291,821 | 7,162,269 |
| 7,162,222 | 10/291,822 | 10/291,524 | 10/291,553 | 6,850,931 |
| 6,865,570 | 6,847,961 | 10/685,523 | 10/685,583 | 7,162,442 |
| 10/685,584 | 7,159,784 | 10/804,034 | 10/793,933 | 6,889,896 |
| 10/831,232 | 7,174,056 | 6,996,274 | 7,162,088 | 10/943,874 |
| 10/943,872 | 10/944,044 | 7,259,884 | 10/944,043 | 7,167,270 |
| 10/943,877 | 6,986,459 | 10/954,170 | 7,181,448 | 10/981,626 |
| 10/981,616 | 10/981,627 | 7,231,293 | 7,174,329 | 10/992,713 |
| 11/006,536 | 7,200,591 | 11/020,106 | 11/020,260 | 11/020,321 |
| 11/020,319 | 11/026,045 | 11/059,696 | 11/051,032 | 11/059,674 |
| 11/107,944 | 11/107,941 | 11/082,940 | 11/082,815 | 11/082,827 |
| 11/082,829 | 6,991,153 | 6,991,154 | 11/124,256 | 11/123,136 |
| 11/154,676 | 11/159,196 | 11/182,002 | 11/202,251 | 11/202,252 |
| 11/202,253 | 11/203,200 | 11/202,218 | 11/206,778 | 11/203,424 |
| 11/222,977 | 11/228,450 | 11/227,239 | 11/286,334 | 7,225,402 |
| 11/329,187 | 11/349,143 | 11/491,225 | 11/491,121 | 11/442,428 |
| 11/454,902 | 11/442,385 | 11/478,590 | 7,271,931 | 11/520,170 |
| 11/603,057 | 11/706,964 | 11/739,032 | 11/739,014 | 11/834,633 |
| 11/830,848 | 11/830,849 | 11/839,542 | 11/866,394 | 7,068,382 |
| 7,068,382 | 7,007,851 | 6,957,921 | 6,457,883 | 10/743,671 |
| 7,044,381 | 11/203,205 | 7,094,910 | 7,091,344 | 7,122,685 |
| 7,038,066 | 7,099,019 | 7,062,651 | 7,062,651 | 6,789,194 |
| 6,789,194 | 6,789,191 | 6,789,191 | 10/900,129 | 7,278,018 |
| 10/913,350 | 10/982,975 | 10/983,029 | 11/331,109 | 6,644,642 |
| 6,644,642 | 6,502,614 | 6,502,614 | 6,622,999 | 6,622,999 |
| 6,669,385 | 6,669,385 | 6,827,116 | 7,011,128 | 10/949,307 |
| 6,549,935 | 6,549,935 | 6,987,573 | 6,987,573 | 6,727,996 |
| 6,727,996 | 6,591,884 | 6,591,884 | 6,439,706 | 6,439,706 |
| 6,760,119 | 6,760,119 | 09/575,198 | 09/575,198 | 7,064,851 |
| 6,826,547 | 6,290,349 | 6,290,349 | 6,428,155 | 6,428,155 |

-continued

| | | | | |
|---|---|---|---|---|
| 6,785,016 | 6,785,016 | 6,831,682 | 6,741,871 | 6,927,871 |
| 6,980,306 | 6,965,439 | 6,840,606 | 7,036,918 | 6,977,746 |
| 6,970,264 | 7,068,389 | 7,093,991 | 7,190,491 | 10/901,154 |
| 10/932,044 | 10/962,412 | 7,177,054 | 10/962,552 | 10/965,733 |
| 10/965,933 | 10/974,742 | 10/982,974 | 7,180,609 | 10/986,375 |
| 11/107,817 | 11/148,238 | 11/149,160 | 11/206,756 | 11/250,465 |
| 7,202,959 | 11/653,219 | 11/706,309 | 11/730,389 | 11/730,392 |
| 60/953,443 | 11/866,387 | 60/974,077 | 6,982,798 | 6,870,966 |
| 6,870,966 | 6,822,639 | 6,822,639 | 6,474,888 | 6,627,870 |
| 6,724,374 | 6,788,982 | 7,263,270 | 6,788,293 | 6,946,672 |
| 6,737,591 | 6,737,591 | 7,091,960 | 09/693,514 | 6,792,165 |
| 7,105,753 | 6,795,593 | 6,980,704 | 6,768,821 | 7,132,612 |
| 7,041,916 | 6,797,895 | 7,015,901 | 10/782,894 | 7,148,644 |
| 10/778,056 | 10/778,058 | 10/778,060 | 10/778,059 | 10/778,063 |
| 10/778,062 | 10/778,061 | 10/778,057 | 7,096,199 | 10/917,468 |
| 10/917,467 | 10/917,466 | 10/917,465 | 7,218,978 | 7,245,294 |
| 7,277,085 | 7,187,370 | 10/917,436 | 10/943,856 | 10/919,379 |
| 7,019,319 | 10/943,878 | 10/943,849 | 7,043,096 | 7,148,499 |
| 11/144,840 | 11/155,556 | 11/155,557 | 11/193,481 | 11/193,435 |
| 11/193,482 | 11/193,479 | 11/255,941 | 11/281,671 | 11/298,474 |
| 7,245,760 | 11/488,832 | 11/495,814 | 11/495,823 | 11/495,822 |
| 11/495,821 | 11/495,820 | 11/653,242 | 11/754,370 | 60/911,260 |
| 11/829,936 | 11/839,494 | 11/866,305 | 11/866,313 | 11/866,324 |
| 11/866,336 | 11/866,348 | 11/866,359 | 7,055,739 | 7,055,739 |
| 7,233,320 | 7,233,320 | 6,830,196 | 6,830,196 | 6,832,717 |
| 6,832,717 | 7,182,247 | 7,120,853 | 7,082,562 | 6,843,420 |
| 10/291,718 | 6,789,731 | 7,057,608 | 6,766,944 | 6,766,945 |
| 10/291,715 | 10/291,559 | 10/291,660 | 7,264,173 | 10/409,864 |
| 7,108,192 | 10/537,159 | 7,111,791 | 7,077,333 | 6,983,878 |
| 10/786,631 | 7,134,598 | 10/893,372 | 6,929,186 | 6,994,264 |
| 7,017,826 | 7,014,123 | 7,134,601 | 7,150,396 | 10/971,146 |
| 7,017,823 | 7,025,276 | 10/990,459 | 7,080,780 | 11/074,802 |
| 11/442,366 | 11/749,158 | 11/842,948 | 10/492,169 | 10/492,152 |
| 10/492,168 | 10/492,161 | 10/492,154 | 10/502,575 | 10/531,229 |
| 10/683,151 | 10/531,733 | 10/683,040 | 10/510,391 | 10/510,392 |
| 10/778,090 | 6,957,768 | 6,957,768 | 09/575,172 | 09/575,172 |
| 7,170,499 | 7,170,499 | 7,106,888 | 7,106,888 | 7,123,239 |
| 7,123,239 | 6,982,701 | 6,982,703 | 7,227,527 | 6,786,397 |
| 6,947,027 | 6,975,299 | 7,139,431 | 7,048,178 | 7,118,025 |
| 6,839,053 | 7,015,900 | 7,010,147 | 7,133,557 | 6,914,593 |
| 10/291,546 | 6,938,826 | 7,278,566 | 7,123,245 | 6,992,662 |
| 7,190,346 | 11/074,800 | 11/074,782 | 11/074,777 | 11/075,917 |
| 7,221,781 | 11/102,843 | 7,213,756 | 11/188,016 | 7,180,507 |
| 7,263,225 | 11/442,114 | 11/737,094 | 11/753,570 | 11/782,596 |
| 11/865,711 | 11/856,061 | 11/856,062 | 11/856,064 | 11/856,066 |
| 11/672,522 | 11/672,950 | 11/672,947 | 11/672,891 | 11/672,954 |
| 11/672,533 | 11/754,310 | 11/754,321 | 11/754,320 | 11/754,319 |
| 11/754,318 | 11/754,317 | 11/754,316 | 11/754,315 | 11/754,314 |
| 11/754,313 | 11/754,312 | 11/754,311 | 6,593,166 | 7,132,679 |
| 6,940,088 | 7,119,357 | 11/513,077 | 6,755,513 | 6,974,204 |
| 6,409,323 | 7,055,930 | 6,281,912 | 6,893,109 | 6,604,810 |
| 6,824,242 | 6,318,920 | 7,210,867 | 6,488,422 | 6,655,786 |
| 6,457,810 | 6,485,135 | 6,796,731 | 6,904,678 | 6,641,253 |
| 7,125,106 | 6,786,658 | 7,097,273 | 6,824,245 | 7,222,947 |
| 6,918,649 | 6,860,581 | 6,929,351 | 7,063,404 | 6,969,150 |
| 7,004,652 | 6,871,938 | 6,905,194 | 6,846,059 | 6,997,626 |
| 10/974,881 | 7,029,098 | 6,966,625 | 7,114,794 | 7,207,646 |
| 7,077,496 | 11/071,117 | 11/072,529 | 7,152,938 | 7,182,434 |
| 7,182,430 | 11/102,842 | 7,032,993 | 11/155,513 | 11/155,545 |
| 11/144,813 | 7,172,266 | 7,258,430 | 7,128,392 | 7,210,866 |
| 11/488,066 | 11/505,933 | 11/540,727 | 11/635,480 | 11/707,946 |
| 11/706,303 | 11/709,084 | 11/730,776 | 11/744,143 | 11/779,845 |
| 11/782,589 | 11/863,256 | 11/066,161 | 11/066,160 | 11/066,159 |
| 11/066,158 | 11/066,165 | 6,804,030 | 6,807,315 | 6,771,811 |
| 6,683,996 | 7,271,936 | 10/934,490 | 6,965,691 | 7,058,219 |
| 10/943,977 | 7,187,807 | 7,181,063 | 11/338,783 | 11/603,823 |
| 11/650,536 | 10/727,181 | 10/727,162 | 10/727,163 | 10/727,245 |
| 7,121,639 | 7,165,824 | 7,152,942 | 10/727,157 | 7,181,572 |
| 7,096,137 | 10/727,257 | 7,278,034 | 7,188,282 | 10/727,159 |
| 10/727,180 | 10/727,179 | 10/727,192 | 10/727,274 | 10/727,164 |
| 10/727,161 | 10/727,198 | 10/727,158 | 10/754,536 | 10/754,938 |
| 10/727,227 | 10/727,160 | 10/934,720 | 7,171,323 | 7,278,697 |
| 11/442,131 | 11/474,278 | 11/488,853 | 11/488,841 | 11/749,750 |
| 11/749,749 | 10/296,522 | 6,795,215 | 7,070,098 | 7,154,638 |
| 6,805,419 | 6,859,289 | 6,977,751 | 6,398,332 | 6,394,573 |
| 6,622,923 | 6,747,760 | 6,921,144 | 10/884,881 | 7,092,112 |
| 7,192,106 | 11/039,866 | 7,173,739 | 6,986,560 | 7,008,033 |
| 11/148,237 | 7,222,780 | 7,270,391 | 7,150,510 | 11/478,599 |
| 11/499,749 | 11/521,388 | 11/738,518 | 11/482,981 | 11/743,662 |
| 11/743,661 | 11/743,659 | 11/743,655 | 11/743,657 | 11/752,900 |

-continued

| | | | | |
|---|---|---|---|---|
| 7,195,328 | 7,182,422 | 11/650,537 | 11/712,540 | 10/854,521 |
| 10/854,522 | 10/854,488 | 10/854,487 | 10/854,503 | 10/854,504 |
| 10/854,509 | 7,188,928 | 7,093,989 | 10/854,497 | 10/854,495 |
| 10/854,498 | 10/854,511 | 10/854,512 | 10/854,525 | 10/854,526 |
| 10/854,516 | 10/854,508 | 7,252,353 | 10/854,515 | 7,267,417 |
| 10/854,505 | 10/854,493 | 7,275,805 | 10/854,489 | 10/854,490 |
| 10/854,492 | 10/854,491 | 10/854,528 | 10/854,523 | 10/854,527 |
| 10/854,524 | 10/854,520 | 10/854,514 | 10/854,519 | 10/854,513 |
| 10/854,499 | 10/854,501 | 7,266,661 | 7,243,193 | 10/854,518 |
| 10/854,517 | 10/934,628 | 7,163,345 | 11/499,803 | 11/601,757 |
| 11/706,295 | 11/735,881 | 11/748,483 | 11/749,123 | 11/766,061 |
| 11/775,135 | 11/772,235 | 11/778,569 | 11/829,942 | 11/014,731 |
| D529081 | D541848 | D528597 | 6,924,907 | 6,712,452 |
| 6,416,160 | 6,238,043 | 6,958,826 | 6,812,972 | 6,553,459 |
| 6,967,741 | 6,956,669 | 6,903,766 | 6,804,026 | 7,259,889 |
| 6,975,429 | 10/636,234 | 10/636,233 | 10/636,217 | 10/636,216 |
| 7,274,485 | 7,139,084 | 7,173,735 | 7,068,394 | 10/636,276 |
| 7,086,644 | 7,250,977 | 7,146,281 | 7,023,567 | 7,136,183 |
| 7,083,254 | 6,796,651 | 7,061,643 | 7,057,758 | 6,894,810 |
| 6,995,871 | 7,085,010 | 7,092,126 | 7,123,382 | 7,061,650 |
| 10/853,143 | 6,986,573 | 6,974,212 | 10/943,907 | 7,173,737 |
| 10/954,168 | 7,246,868 | 11/065,357 | 7,137,699 | 11/107,798 |
| 7,148,994 | 7,077,497 | 11/176,372 | 7,248,376 | 11/225,158 |
| 11/225,154 | 7,173,729 | 11/442,132 | 11/478,607 | 11/503,085 |
| 11/545,502 | 11/583,943 | 11/585,946 | 11/653,239 | 11/653,238 |
| 11/764,781 | 11/764,782 | 11/779,884 | 11/845,666 | 11/544,764 |
| 11/544,765 | 11/544,772 | 11/544,773 | 11/544,774 | 11/544,775 |
| 11/544,776 | 11/544,766 | 11/544,767 | 11/544,771 | 11/544,770 |
| 11/544,769 | 11/544,777 | 11/544,768 | 11/544,763 | 11/293,804 |
| 11/293,840 | 11/293,803 | 11/293,833 | 11/293,834 | 11/293,835 |
| 11/293,836 | 11/293,837 | 11/293,792 | 11/293,794 | 11/293,839 |
| 11/293,826 | 11/293,829 | 11/293,830 | 11/293,827 | 11/293,828 |
| 7,270,494 | 11/293,823 | 11/293,824 | 11/293,831 | 11/293,815 |
| 11/293,819 | 11/293,818 | 11/293,817 | 11/293,816 | 11/838,875 |
| 11/482,978 | 11/640,356 | 11/640,357 | 11/640,358 | 11/640,359 |
| 11/640,360 | 11/640,355 | 11/679,786 | 10/760,254 | 10/760,210 |
| 10/760,202 | 7,201,468 | 10/760,198 | 10/760,249 | 7,234,802 |
| 10/760,196 | 10/760,247 | 7,156,511 | 10/760,264 | 7,258,432 |
| 7,097,291 | 10/760,222 | 10/760,248 | 7,083,273 | 10/760,192 |
| 10/760,203 | 10/760,204 | 10/760,205 | 10/760,206 | 10/760,267 |
| 10/760,270 | 7,198,352 | 10/760,271 | 10/760,275 | 7,201,470 |
| 7,121,655 | 10/760,184 | 7,232,208 | 10/760,186 | 10/760,261 |
| 7,083,272 | 7,261,400 | 11/474,272 | 11/474,315 | 11/501,771 |
| 11/583,874 | 11/650,554 | 11/706,322 | 11/706,968 | 11/749,119 |
| 11/749,157 | 11/779,848 | 11/782,590 | 11/855,152 | 11/855,151 |
| 11/014,764 | 11/014,763 | 11/014,748 | 11/014,747 | 11/014,761 |
| 11/014,760 | 11/014,757 | 11/014,714 | 7,249,822 | 11/014,762 |
| 11/014,724 | 11/014,723 | 11/014,756 | 11/014,736 | 11/014,759 |
| 11/014,758 | 11/014,725 | 11/014,739 | 11/014,738 | 11/014,737 |
| 11/014,726 | 11/014,745 | 11/014,712 | 7,270,405 | 11/014,751 |
| 11/014,735 | 11/014,734 | 11/014,719 | 11/014,750 | 11/014,749 |
| 7,249,833 | 11/758,640 | 11/775,143 | 11/838,877 | 11/014,769 |
| 11/014,729 | 11/014,743 | 11/014,733 | 11/014,754 | 11/014,755 |
| 11/014,765 | 11/014,766 | 11/014,740 | 11/014,720 | 11/014,753 |
| 7,255,430 | 11/014,744 | 11/014,741 | 11/014,768 | 11/014,767 |
| 11/014,718 | 11/014,717 | 11/014,716 | 11/014,732 | 11/014,742 |
| 11/097,268 | 11/097,185 | 11/097,184 | 11/778,567 | 11/852,958 |
| 11/852,907 | 11/293,820 | 11/293,813 | 11/293,822 | 11/293,812 |
| 11/293,821 | 11/293,814 | 11/293,793 | 11/293,842 | 11/293,811 |
| 11/293,807 | 11/293,806 | 11/293,805 | 11/293,810 | 11/688,863 |
| 11/688,864 | 11/688,865 | 11/688,866 | 11/688,867 | 11/688,868 |
| 11/688,869 | 11/688,871 | 11/688,872 | 11/688,873 | 11/741,766 |
| 11/482,982 | 11/482,983 | 11/482,984 | 11/495,818 | 11/495,819 |
| 11/677,049 | 11/677,050 | 11/677,051 | 11/014,722 | D528156 |
| 10/760,180 | 7,111,935 | 10/760,213 | 10/760,219 | 10/760,237 |
| 7,261,482 | 10/760,220 | 7,002,664 | 10/760,252 | 10/760,265 |
| 7,088,420 | 11/446,233 | 11/503,083 | 11/503,081 | 11/516,487 |
| 11/599,312 | 6,364,451 | 6,533,390 | 6,454,378 | 7,224,478 |
| 6,559,969 | 6,896,362 | 7,057,760 | 6,982,799 | 11/202,107 |
| 11/743,672 | 11/744,126 | 11/743,673 | 7,093,494 | 7,143,652 |
| 7,089,797 | 7,159,467 | 7,234,357 | 7,124,643 | 7,121,145 |
| 7,089,790 | 7,194,901 | 6,968,744 | 7,089,798 | 7,240,560 |
| 7,137,302 | 11/442,177 | 7,171,855 | 7,260,995 | 7,260,993 |
| 7,165,460 | 7,222,538 | 7,258,019 | 11/543,047 | 7,258,020 |
| 11/604,324 | 11/642,520 | 11/706,305 | 11/707,056 | 11/744,211 |
| 11/767,526 | 11/779,846 | 11/764,227 | 11/829,943 | 11/829,944 |
| 6,454,482 | 6,808,330 | 6,527,365 | 6,474,773 | 6,550,997 |
| 7,093,923 | 6,957,923 | 7,131,724 | 10/949,288 | 7,168,867 |
| 7,125,098 | 11/706,966 | 11/185,722 | 7,249,901 | 7,188,930 |
| 11/014,728 | 11/014,727 | D536031 | D531214 | 7,237,888 |

-continued

| | | | | |
|---|---|---|---|---|
| 7,168,654 | 7,201,272 | 6,991,098 | 7,217,051 | 6,944,970 |
| 10/760,215 | 7,108,434 | 10/760,257 | 7,210,407 | 7,186,042 |
| 10/760,266 | 6,920,704 | 7,217,049 | 10/760,214 | 10/760,260 |
| 7,147,102 | 10/760,269 | 7,249,838 | 10/760,241 | 10/962,413 |
| 10/962,427 | 7,261,477 | 7,225,739 | 10/962,402 | 10/962,425 |
| 10/962,428 | 7,191,978 | 10/962,426 | 10/962,409 | 10/962,417 |
| 10/962,403 | 7,163,287 | 7,258,415 | 10/962,523 | 7,258,424 |
| 10/962,410 | 7,195,412 | 7,207,670 | 7,270,401 | 7,220,072 |
| 11/474,267 | 11/544,547 | 11/585,925 | 11/593,000 | 11/706,298 |
| 11/706,296 | 11/706,327 | 11/730,760 | 11/730,407 | 11/730,787 |
| 11/735,977 | 11/736,527 | 11/753,566 | 11/754,359 | 11/778,061 |
| 11/765,398 | 11/778,556 | 11/829,937 | 11/780,470 | 11/866,399 |
| 11/223,262 | 11/223,018 | 11/223,114 | 11/223,022 | 11/223,021 |
| 11/223,020 | 11/223,019 | 11/014,730 | D541849 | 29/279,123 |
| 6,716,666 | 6,949,217 | 6,750,083 | 7,014,451 | 6,777,259 |
| 6,923,524 | 6,557,978 | 6,991,207 | 6,766,998 | 6,967,354 |
| 6,759,723 | 6,870,259 | 10/853,270 | 6,925,875 | 10/898,214 |
| 7,095,109 | 7,145,696 | 10/976,081 | 7,193,482 | 7,134,739 |
| 7,222,939 | 7,164,501 | 7,118,186 | 7,201,523 | 7,226,159 |
| 7,249,839 | 7,108,343 | 7,154,626 | 7,079,292 | 10/980,184 |
| 7,233,421 | 7,063,408 | 10/983,082 | 10/982,804 | 7,032,996 |
| 10/982,834 | 10/982,833 | 10/982,817 | 7,217,046 | 6,948,870 |
| 7,195,336 | 7,070,257 | 10/986,813 | 10/986,785 | 7,093,922 |
| 6,988,789 | 10/986,788 | 7,246,871 | 10/992,748 | 10/992,747 |
| 7,187,468 | 10/992,828 | 7,196,814 | 10/992,754 | 7,268,911 |
| 7,265,869 | 7,128,384 | 7,164,505 | 11/003,595 | 7,025,434 |
| 11/003,481 | 11/003,485 | 7,206,098 | 7,265,877 | 7,193,743 |
| 7,168,777 | 11/006,734 | 7,195,329 | 7,198,346 | 11/006,739 |
| 11/013,363 | 11/013,881 | 6,959,983 | 7,128,386 | 7,097,104 |
| 11/013,636 | 7,083,261 | 7,070,258 | 7,083,275 | 7,110,139 |
| 6,994,419 | 6,935,725 | 11/026,046 | 7,178,892 | 7,219,429 |
| 6,988,784 | 11/026,135 | 11/026,326 | 11/064,005 | 11/064,006 |
| 7,178,903 | 7,273,274 | 7,083,256 | 11/064,008 | 11/064,009 |
| 11/064,013 | 6,974,206 | 11/064,004 | 7,066,588 | 7,222,940 |
| 11/075,918 | 7,018,025 | 7,221,867 | 11/072,517 | 7,188,938 |
| 7,021,742 | 7,083,262 | 7,192,119 | 11/083,021 | 7,036,912 |
| 7,175,256 | 7,182,441 | 7,083,258 | 7,114,796 | 7,147,302 |
| 11/084,757 | 7,219,982 | 7,118,195 | 7,229,153 | 6,991,318 |
| 7,108,346 | 11/248,429 | 11/239,031 | 7,178,899 | 7,066,579 |
| 11/281,419 | 11/298,633 | 11/329,188 | 11/329,140 | 7,270,397 |
| 7,258,425 | 7,237,874 | 7,152,961 | 11/478,592 | 7,207,658 |
| 11/484,744 | 11/488,867 | 7,207,659 | 11/525,857 | 11/540,569 |
| 11/583,869 | 11/592,985 | 11/601,762 | 11/604,316 | 11/604,309 |
| 11/604,303 | 11/643,844 | 11/650,553 | 11/655,940 | 11/653,320 |
| 11/706,294 | 11/706,381 | 11/706,323 | 11/706,963 | 11/713,660 |
| 11/730,408 | 11/696,186 | 11/730,390 | 11/737,139 | 11/737,749 |
| 11/740,273 | 11/749,122 | 11/754,361 | 11/766,043 | 11/764,775 |
| 11/768,872 | 11/775,156 | 11/779,271 | 11/779,272 | 11/829,938 |
| 11/839,502 | 11/858,852 | 9628 | 5382 | 6,485,123 |
| 6,425,657 | 6,488,358 | 7,021,746 | 6,712,986 | 6,981,757 |
| 6,505,912 | 6,439,694 | 6,364,461 | 6,378,990 | 6,425,658 |
| 6,488,361 | 6,814,429 | 6,471,336 | 6,457,813 | 6,540,331 |
| 6,454,396 | 6,464,325 | 6,443,559 | 6,435,664 | 6,412,914 |
| 6,488,360 | 6,550,896 | 6,439,695 | 6,447,100 | 09/900,160 |
| 6,488,359 | 6,637,873 | 10/485,738 | 6,618,117 | 10/485,737 |
| 6,803,989 | 7,234,801 | 7,044,589 | 7,163,273 | 6,416,154 |
| 6,547,364 | 10/485,744 | 6,644,771 | 7,152,939 | 6,565,181 |
| 10/485,805 | 6,857,719 | 7,255,414 | 6,702,417 | 10/485,652 |
| 6,918,654 | 7,070,265 | 6,616,271 | 6,652,078 | 6,503,408 |
| 6,607,263 | 7,111,924 | 6,623,108 | 6,698,867 | 6,488,362 |
| 6,625,874 | 6,921,153 | 7,198,356 | 6,536,874 | 6,425,651 |
| 6,435,667 | 10/509,997 | 6,527,374 | 10/510,154 | 6,582,059 |
| 10/510,152 | 6,513,908 | 7,246,883 | 6,540,332 | 6,547,368 |
| 7,070,256 | 6,508,546 | 10/510,151 | 6,679,584 | 10/510,000 |
| 6,857,724 | 10/509,998 | 6,652,052 | 10/509,999 | 6,672,706 |
| 10/510,096 | 6,688,719 | 6,712,924 | 6,588,886 | 7,077,508 |
| 7,207,654 | 6,935,724 | 6,927,786 | 6,988,787 | 6,899,415 |
| 6,672,708 | 6,644,767 | 6,874,866 | 6,830,316 | 6,994,420 |
| 6,954,254 | 7,086,720 | 7,240,992 | 7,267,424 | 7,128,397 |
| 7,084,951 | 7,156,496 | 7,066,578 | 7,101,023 | 11/165,027 |
| 11/202,235 | 11/225,157 | 7,159,965 | 7,255,424 | 11/349,519 |
| 7,137,686 | 7,201,472 | 11/442,413 | 11/504,602 | 7,216,957 |
| 11/520,572 | 11/583,858 | 11/583,895 | 11/585,976 | 11/635,488 |
| 11/653,314 | 11/706,952 | 11/706,307 | 11/785,109 | 11/740,287 |
| 11/754,367 | 11/758,643 | 11/778,572 | 11/859,791 | 11/863,260 |
| 6,916,082 | 6,786,570 | 10/753,478 | 6,848,780 | 6,966,633 |
| 7,179,395 | 6,969,153 | 6,979,075 | 7,132,056 | 6,832,828 |
| 6,860,590 | 6,905,620 | 6,786,574 | 6,824,252 | 7,097,282 |
| 6,997,545 | 6,971,734 | 6,918,652 | 6,978,990 | 6,863,105 |
| 10/780,624 | 7,194,629 | 10/791,792 | 6,890,059 | 6,988,785 |

-continued

| | | | | |
|---|---|---|---|---|
| 6,830,315 | 7,246,881 | 7,125,102 | 7,028,474 | 7,066,575 |
| 6,986,202 | 7,044,584 | 7,210,762 | 7,032,992 | 7,140,720 |
| 7,207,656 | 11/031,084 | 11/048,748 | 7,008,041 | 7,011,390 |
| 7,048,868 | 7,014,785 | 7,131,717 | 11/148,236 | 11/176,158 |
| 7,182,436 | 7,104,631 | 7,240,993 | 11/206,920 | 11/202,217 |
| 7,172,265 | 11/231,876 | 7,066,573 | 11/298,635 | 7,152,949 |
| 11/442,161 | 11/442,133 | 11/442,126 | 7,156,492 | 11/478,588 |
| 11/505,848 | 11/520,569 | 11/525,861 | 11/583,939 | 11/545,504 |
| 11/583,894 | 11/635,485 | 11/730,391 | 11/730,788 | 11/749,148 |
| 11/749,149 | 11/749,152 | 11/749,151 | 11/759,886 | 11/865,668 |
| 6,824,257 | 7,270,475 | 6,971,811 | 6,878,564 | 6,921,145 |
| 6,890,052 | 7,021,747 | 6,929,345 | 6,811,242 | 6,916,087 |
| 6,905,195 | 6,899,416 | 6,883,906 | 6,955,428 | 10/882,775 |
| 6,932,459 | 6,962,410 | 7,033,008 | 6,962,409 | 7,013,641 |
| 7,204,580 | 7,032,997 | 6,998,278 | 7,004,563 | 6,910,755 |
| 6,969,142 | 6,938,994 | 7,188,935 | 10/959,049 | 7,134,740 |
| 6,997,537 | 7,004,567 | 6,916,091 | 7,077,588 | 6,918,707 |
| 6,923,583 | 6,953,295 | 6,921,221 | 7,001,008 | 7,168,167 |
| 7,210,759 | 11/008,115 | 11/011,120 | 11/012,329 | 6,988,790 |
| 7,192,120 | 7,168,789 | 7,004,577 | 7,052,120 | 11/123,007 |
| 6,994,426 | 7,258,418 | 7,014,298 | 11/124,348 | 11/177,394 |
| 7,152,955 | 7,097,292 | 7,207,657 | 7,152,944 | 7,147,303 |
| 11/209,712 | 7,134,608 | 7,264,333 | 7,093,921 | 7,077,590 |
| 7,147,297 | 11/239,029 | 11/248,832 | 11/248,428 | 11/248,434 |
| 7,077,507 | 7,172,672 | 7,175,776 | 7,086,717 | 7,101,020 |
| 11/329,155 | 7,201,466 | 11/330,057 | 7,152,967 | 7,182,431 |
| 7,210,666 | 7,252,367 | 11/450,586 | 11/485,255 | 11/525,860 |
| 6,945,630 | 7,018,294 | 6,910,014 | 6,659,447 | 6,648,321 |
| 7,082,980 | 6,672,584 | 7,073,551 | 6,830,395 | 10/309,025 |
| 7,001,011 | 6,880,922 | 6,886,915 | 6,644,787 | 6,641,255 |
| 7,066,580 | 6,652,082 | 10/309,036 | 6,666,544 | 6,666,543 |
| 6,669,332 | 6,984,023 | 6,733,104 | 6,644,793 | 6,723,575 |
| 6,953,235 | 6,663,225 | 7,076,872 | 7,059,706 | 7,185,971 |
| 7,090,335 | 6,854,827 | 6,793,974 | 10/636,258 | 7,222,929 |
| 6,739,701 | 7,073,881 | 7,155,823 | 7,219,427 | 7,008,503 |
| 6,783,216 | 6,883,890 | 6,857,726 | 10/636,274 | 6,641,256 |
| 6,808,253 | 6,827,428 | 6,802,587 | 6,997,534 | 6,959,982 |
| 6,959,981 | 6,886,917 | 6,969,473 | 6,827,425 | 7,007,859 |
| 6,802,594 | 6,792,754 | 6,860,107 | 6,786,043 | 6,863,378 |
| 7,052,114 | 7,001,007 | 10/729,151 | 10/729,157 | 6,948,794 |
| 6,805,435 | 6,733,116 | 10/683,006 | 7,008,046 | 6,880,918 |
| 7,066,574 | 6,983,595 | 6,923,527 | 7,275,800 | 7,163,276 |
| 7,156,495 | 6,976,751 | 6,994,430 | 7,014,296 | 7,059,704 |
| 7,160,743 | 7,175,775 | 11/058,238 | 7,097,283 | 7,140,722 |
| 11/123,009 | 11/123,008 | 7,080,893 | 7,093,920 | 7,270,492 |
| 7,128,093 | 7,052,113 | 7,055,934 | 11/155,627 | 11/149,324 |
| 11/159,197 | 7,083,263 | 7,145,592 | 7,025,436 | 11/281,444 |
| 7,258,421 | 11/478,591 | 11/478,735 | 7,226,147 | 11/482,940 |
| 7,195,339 | 11/503,061 | 11/505,938 | 11/520,577 | 11/525,863 |
| 11/544,577 | 11/540,576 | 11/585,964 | 11/592,991 | 11/599,342 |
| 11/600,803 | 11/604,321 | 11/604,302 | 11/635,535 | 11/635,486 |
| 11/643,842 | 11/655,987 | 11/650,541 | 11/706,301 | 11/707,039 |
| 11/730,388 | 11/730,786 | 11/730,785 | 11/739,080 | 11/764,746 |
| 11/768,875 | 11/779,847 | 11/829,940 | 11/847,240 | 11/834,625 |
| 11/863,210 | 11/865,680 | 7,067,067 | 6,776,476 | 6,880,914 |
| 7,086,709 | 6,783,217 | 7,147,791 | 6,929,352 | 7,144,095 |
| 6,820,974 | 6,918,647 | 6,984,016 | 7,192,125 | 6,824,251 |
| 6,834,939 | 6,840,600 | 6,786,573 | 7,144,519 | 6,799,835 |
| 6,959,975 | 6,959,974 | 7,021,740 | 6,935,718 | 6,938,983 |
| 6,938,991 | 7,226,145 | 7,140,719 | 6,988,788 | 7,022,250 |
| 6,929,350 | 7,011,393 | 7,004,566 | 7,175,097 | 6,948,799 |
| 7,143,944 | 10/965,737 | 7,029,100 | 6,957,811 | 7,073,724 |
| 7,055,933 | 7,077,490 | 7,055,940 | 10/991,402 | 7,234,645 |
| 7,032,999 | 7,066,576 | 7,229,150 | 7,086,728 | 7,246,879 |
| 11/144,809 | 7,140,718 | 11/144,802 | 7,144,098 | 7,044,577 |
| 11/144,808 | 11/172,896 | 7,189,334 | 7,055,935 | 7,152,860 |
| 11/203,188 | 11/203,173 | 11/202,343 | 7,213,989 | 11/225,156 |
| 11/225,173 | 11/228,433 | 7,114,868 | 7,168,796 | 7,159,967 |
| 11/272,425 | 7,152,805 | 11/298,530 | 11/330,061 | 7,133,799 |
| 11/330,054 | 11/329,284 | 7,152,956 | 7,128,399 | 7,147,305 |
| 11/446,241 | 11/442,160 | 7,246,884 | 7,152,960 | 11/442,125 |
| 11/454,901 | 11/442,134 | 11/450,441 | 11/474,274 | 11/499,741 |
| 7,270,399 | 6,857,728 | 6,857,729 | 6,857,730 | 6,989,292 |
| 7,126,216 | 6,977,189 | 6,982,189 | 7,173,332 | 7,026,176 |
| 6,979,599 | 6,812,062 | 6,886,751 | 10/804,057 | 10/804,036 |
| 7,001,793 | 6,866,369 | 6,946,743 | 10/804,048 | 6,886,918 |
| 7,059,720 | 10/846,561 | 10/846,562 | 10/846,647 | 10/846,649 |
| 10/846,627 | 6,951,390 | 6,981,765 | 6,789,881 | 6,802,592 |
| 7,029,097 | 6,799,836 | 7,048,352 | 7,182,267 | 7,025,279 |
| 6,857,571 | 6,817,539 | 6,830,198 | 6,992,791 | 7,038,809 |

-continued

| | | | | |
|---|---|---|---|---|
| 6,980,323 | 7,148,992 | 7,139,091 | 6,947,173 | 7,101,034 |
| 6,969,144 | 6,942,319 | 6,827,427 | 6,984,021 | 6,984,022 |
| 6,869,167 | 6,918,542 | 7,007,852 | 6,899,420 | 6,918,665 |
| 6,997,625 | 6,988,840 | 6,984,080 | 6,845,978 | 6,848,687 |
| 6,840,512 | 6,863,365 | 7,204,582 | 6,921,150 | 7,128,396 |
| 6,913,347 | 7,008,819 | 6,935,736 | 6,991,317 | 11/033,122 |
| 7,055,947 | 7,093,928 | 7,100,834 | 7,270,396 | 7,187,086 |
| 11/072,518 | 7,032,825 | 7,086,721 | 11/171,428 | 7,159,968 |
| 7,010,456 | 7,147,307 | 7,111,925 | 11/144,812 | 7,229,154 |
| 11/505,849 | 11/520,570 | 11/520,575 | 11/546,437 | 11/540,575 |
| 11/583,937 | 11/584,619 | 11/592,211 | 11/592,207 | 11/635,489 |
| 11/604,319 | 11/635,490 | 11/635,525 | 11/650,540 | 11/706,366 |
| 11/706,310 | 11/706,308 | 11/785,108 | 11/744,214 | 11/744,218 |
| 11/748,485 | 11/748,490 | 11/764,778 | 11/766,025 | 11/834,635 |
| 11/839,541 | 11/860,420 | 11/865,693 | 11/863,118 | 11/866,307 |
| 11/866,340 | 11/869,684 | 11/869,722 | 11/869,694 | 11/872,714 |

The disclosures of these applications and patents are incorporated herein by reference.

BACKGROUND

Inkjet printing is a popular and versatile form of print imaging. The Assignee has developed printers that eject ink through MEMS printhead IC's. These printhead IC's (integrated circuits) are formed using lithographic etching and deposition techniques used for semiconductor fabrication.

The micro-scale nozzle structures in MEMS printhead IC's allow a high nozzle density (nozzles per unit of IC surface area), high print resolutions, low power consumption, self cooling operation and therefore high print speeds. Such printheads are described in detail in U.S. Ser. No. 10/160,273 filed Jun. 4, 2002 and U.S. Ser. No. 10/728,804 filed on Dec. 8, 2003 to the present Assignee. The disclosures of these documents are incorporated herein by reference.

The small nozzle structures and high nozzle densities can create difficulties with color mixing between nozzles of different color. During periods of prolonged inactivity (or 'standby mode') the separate fluidic lines for each ink color can undergo slight pressure changes relative to each other. Different rates of heating and outgassing in different ink lines will generate a slight pressure differential. If paper dust or ink residue on the nozzle face extends between nozzles of the different ink lines, the dust or residual ink can forge a fluid connection between the two ink lines. The ink lines try to equalize the pressure difference between them and this drives an ink from the higher pressure line to the lower pressure line. If left unchecked, the ink contamination in the lower pressure ink line can extend to the ink tank. In this case, the contaminated ink supply is irretrievable and needs replacement before the ink lines are flushed through to the nozzles.

The ink tanks can be isolated from the printhead by a shut off valve upstream of the printhead. This protects the tanks from contamination during standby, but there is a risk that the tank and the printhead will generate a pressure difference during the standby period. If this happens, the sudden pressure equalization causes a pulse through the ink line which floods the nozzle plate.

SUMMARY

According to an aspect of the present disclosure, an inkjet printer comprises a printhead for printing onto a media substrate, the printhead defining a plurality of nozzles from which ink is expelled; an ink tank provided upstream of the printhead; a sump provided downstream of the printhead for collecting unused ink from the printhead, the sump having a lower portion for holding the unused ink and an upper portion defining a headspace of air above the unused ink; a first fluid conduit extending between the printhead and the sump for communicating the unused ink from the printhead to the sump, the first fluid conduit connecting the sump to a position in the printhead upstream of the plurality of nozzles; and a pump connected to the sump, the pump for drawing air from the headspace of the sump into atmosphere and effecting a negative pressure in the printhead upstream of the nozzles. Communication of ink from the ink tank to the printhead is effected by the negative pressure generated by the drawing of air from the headspace of the sump.

BRIEF DESCRIPTION OF THE DRAWINGS

Preferred embodiments of the invention will now be described by way of example only, with reference to the accompanying drawings in which.

DETAILED DESCRIPTION

Figure 1:
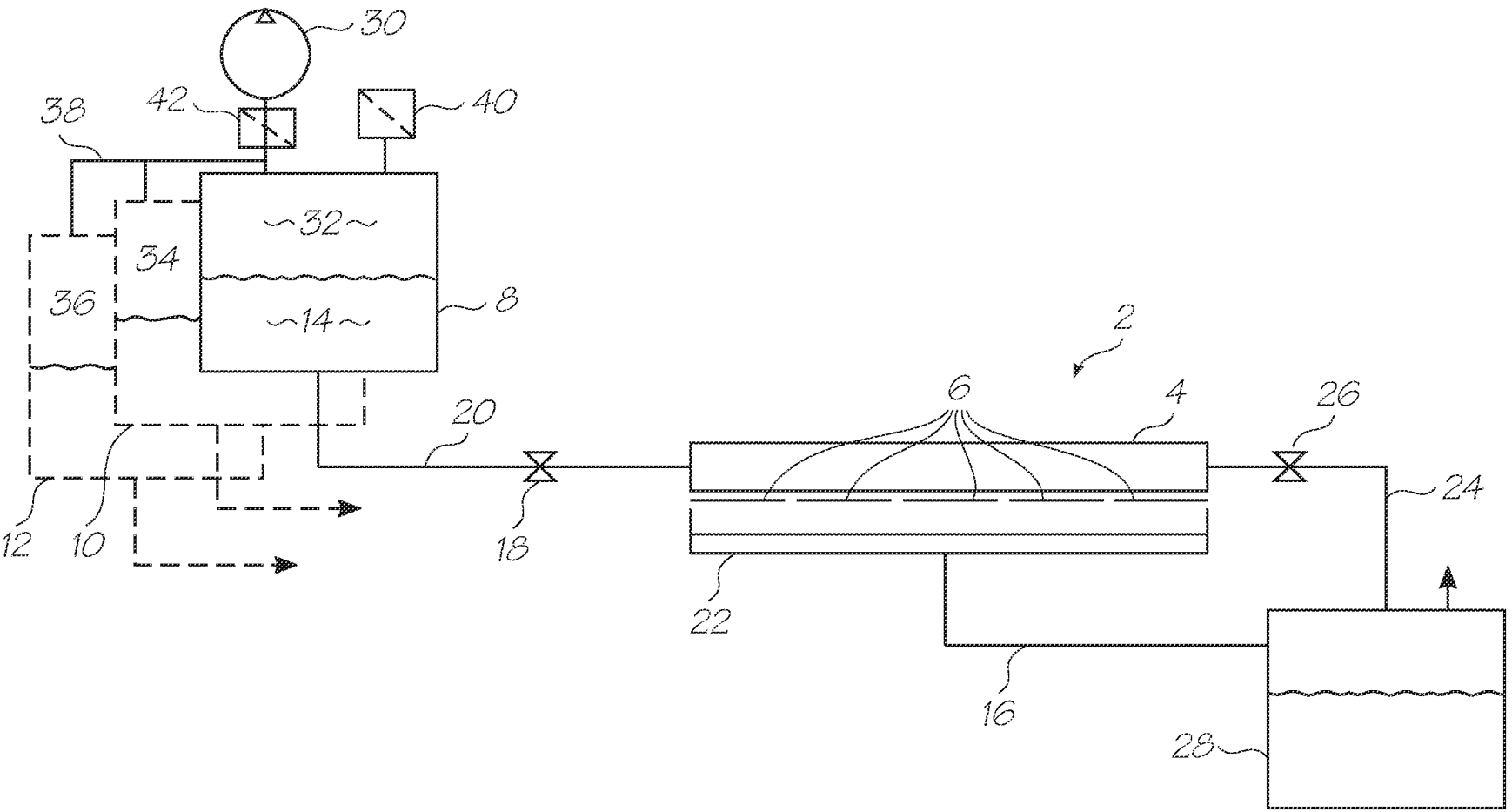
FIG. 1 shows a schematic diagram of a printer fluidic system according to the present invention; and, FIG. 2 shows a schematic diagram of another printer fluidic system according to the present invention.

Referring to FIG. 1, the printer fluidics system is shown schematically for the purposes of illustration. A single ink line for one color is shown in full. The ink tanks 10 and 12 for other color are shown in dotted line. A color printer would have complete ink lines for each ink color. Most of the individual components within the system are shown and described in much greater detail in the Applicant's co-pending application U.S. Ser. No. 11/688,863, filed on Mar. 21, 2007, the contents of which are incorporated herein by cross reference. Components of the present system that are not shown in the cross referenced document, are commercially available.

The fluidic system shown in FIG. 1 has a printhead 2 supplied with ink 14 from an ink tank 8 via an upstream ink line 20. Waste ink from the printhead 2 drains to a sump 28 through downstream ink line 24. The upstream ink line 20 has a shut off valve 18 and the downstream ink line has shut off valve 26. These valves can be used for priming and purging ink (discussed below) and as detachable fluid connections is the printhead is provided in the form of user removable and replaceable cartridge such as that shown in the above referenced U.S. Ser. No. 11/688,863, filed on Mar. 21, 2007.

The printhead has a maintenance station 22 for capping and blotting the nozzles. A drain line 16 connects the maintenance station 22 to the sump 28.

The printhead 2 is an assembly of an ink distribution manifold 4 on which a series of printhead integrated circuits (ICs) 6 are mounted. The printhead ICs 6 define the nozzle arrays which eject the ink to the media substrate. The nozzles are MEMS devices which can be thermally actuated such as those described in U.S. Ser. No. 11/482,953 filed on Jul. 10, 2006 or mechanically actuated such as those disclosed in U.S. Ser. No. 10/160,273 filed Jun. 4, 2002.

The ink distribution manifold 4 is an LCP molding with a system of large channels feeding a network of smaller channels to supply the ink to many points along the length of each printhead IC 6. An embodiment of the distribution manifold 4 and the printhead ICs 6 is disclosed in detail in the U.S. Ser. No. 11/688,863 filed Mar. 21, 2007 reference listed above. This document also details the manner in which the printhead is primed with ink or, if necessary, purged of ink to correct any cross channel color contamination and/or bubble removal.

In standby mode, the air pump 30 draws air from the headspace 32 in the tank 8. The air pressure in the headspace drops and air is drawn back into the headspace 32 through the filtered vent 40. The air constriction from the vent 40 is carefully controlled to create a predetermined negative air pressure. The tubing 38 fluidly connects the headspaces 34 and 36 in tanks 10 and 12 such that all the headspaces are at the same air pressure. Tanks 10 and 12 can have their own vents to atmosphere (not shown) but the system will operate with a single vent.

With the headspaces 32, 34, and 36 at the same pressure, the hydrostatic pressure in the ink is very nearly equal. The hydrostatic pressure of the ink at the nozzles will only vary by the variations in the ink levels of the ink tanks Normal usage is designed to keep the ink levels roughly the same in each ink tank. To further minimize variations, the tanks can have a wide and squat shape to reduce the change in hydrostatic pressure from full to empty. With equal pressures (or at least very nearly equal pressures) in each ink line, there is no pressure differential to drive a color mixing process other than diffusion. As the fluid connection across the nozzle is so small, mixing by diffusion is negligible.

The pump 30 is reversible so it can be used to pressurize the headspaces 32, 34 and 36 in order to prime the printhead 2 or purge ink through the printhead ICs 6. Priming requires the upstream and downstream shut off valves 18 and 26 to be open. Ink from the tanks 8, 10 and 12 is forced down the upstream ink line 20, through the distribution manifold 4 and into the sump 28 via the downstream ink line 24. The printhead ICs 6 prime by capillary action from the ink in the distribution manifold.

To purge the printhead ICs 6 (to recover dried nozzles, outgassing bubble blockages etc) the down stream valve 26 is closed as the pump 30 pressurizes the headspace 32. Ink is forced from the nozzles and the resulting flood on the nozzle plate is cleared with the maintenance station 22.

It will be appreciated that the pump 30 operates during a power up standby mode. That is, during periods of inactivity between print jobs, but the printer is still plugged in and connected to a power supply. During a power off standby, the shut off valve 18 and 26 are closed to isolate the printhead and prevent mixing. When the printer powers up again, the pump 30 can be used to ready the printhead by priming or purging (if necessary) as discussed above.

Figure 2:
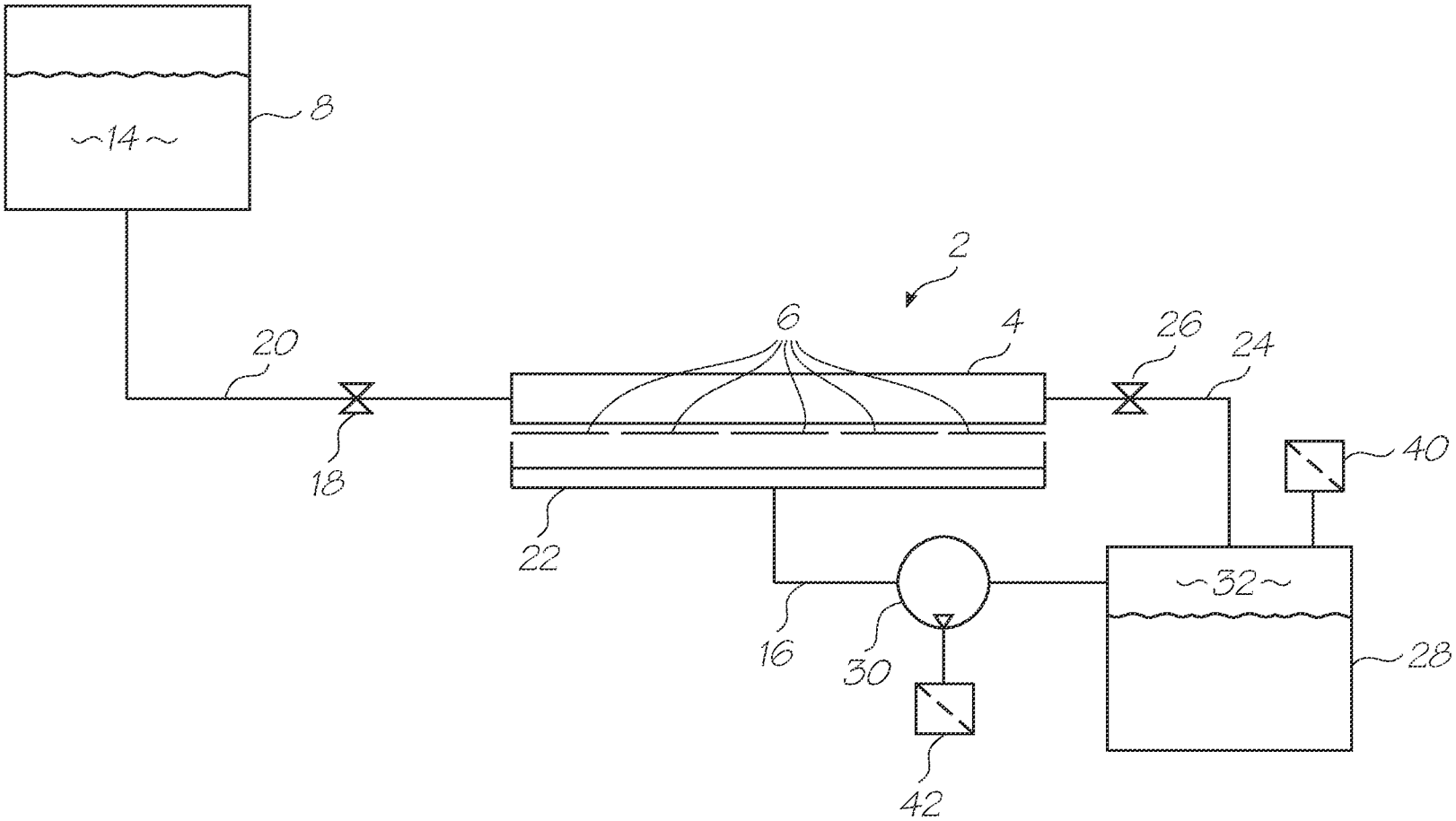

FIG. 2 shows the pump 30 operating on the headspace 32 of the sump 28 instead of the ink tank 8. Again, a single ink line is shown but the color printer will have several color lines all draining to the same sump 28. As long as all the down stream ink lines 24 for each color connect to the sump headspace, a single pump can be used to change the hydrostatic pressures in the ink at the nozzles.

With the pump 30 connected to the sump 28, the upstream shut off valve 18 is closed during power down standby. The negative air pressure in the headspace 32 draws on the column of ink hanging from the printhead 2. This ensures that a sufficiently negative pressure is maintained at the nozzles. More importantly, the negative pressure in the nozzles of each color is the same. As discussed above, this removes the mechanism that drives the color mixing process.

The pump 30 is marginally more complex in that it needs to be able to handle an ink/air mixture. It is in the drain line 16 from the maintenance assembly 22 to the sump 28 to assist the transfer of blotted ink to the sump 28 but needs to be able to draw air from the headspace 32 or from atmosphere through the filter 42.

In this embodiment, priming requires the upstream valve 18 to be open and the pump 30 to create a low pressure in the sump 28 to draw the ink from the tank 8 down the upstream ink line 20, through the distribution manifold 4 and into the downstream ink line 24. Again the printhead ICs 6 prime by capillarity.

To purge, the upstream valve 18 is closed and the pump 30 creates a positive pressure in the headspace 32 to force the ink in the down stream ink line 24 and the distribution manifold 4 to flood the printhead ICs 6.

The invention has been described by way of example only. Ordinary workers in this field will readily recognize any variations and modifications which do not depart from the spirit and scope of the broad inventive concept.

We claim:

1. An inkjet printer, comprising:

a printhead for printing onto a media substrate, the printhead defining a plurality of nozzles from which ink is expelled;

an ink tank provided upstream of the printhead;

a sump provided downstream of the printhead for collecting unused ink from the printhead, the sump having a lower portion for holding the unused ink and an upper portion defining a headspace of air above the unused ink;

a first fluid conduit extending between the printhead and the sump for communicating the unused ink from the printhead to the sump, the first fluid conduit connecting the sump to a position in the printhead upstream of the plurality of nozzles; and a pump connected to the sump, the pump for drawing air from the headspace of the sump into atmosphere and effecting a negative pressure in the printhead upstream of the nozzles, wherein communication of ink from the ink tank to the printhead is effected by the negative pressure generated by the drawing of air from the headspace of the sump.

2. An inkjet printer according to claim 1, wherein the sump has a vent for allowing a throttled flow of air into the headspace as the pump is drawing air out of the headspace.

3. An inkjet printer according to claim 2, wherein the vent has a filter for removing particulate contaminants from the throttled air flow into the headspace.

4. An inkjet printer according to claim 1, further comprising a maintenance assembly provided downstream of the plurality of nozzles, the maintenance assembly for receiving ink drained from the nozzles.

5. An inkjet printer according to claim 4, further comprising a second fluid conduit extending between the maintenance assembly and the sump, the second fluid conduit for communicating ink from the maintenance assembly to the sump.

6. An inkjet printer according to claim 5, wherein the pump is provided along the second fluid conduit, in between the maintenance assembly and the sump.

7. An inkjet printer according to claim 6, wherein the pump operates in a first direction to draw air from the headspace of the sump into atmosphere, and operates in a second direction opposite to the first direction to communicate ink from the maintenance assembly to the sump.

8. An inkjet printer according to claim 1, further comprising an ink supply reservoir provided upstream of the printhead, the ink supply reservoir for storing a volume of ink for use by the printhead.

9. An inkjet printer according to claim 8, wherein the printhead includes an ink distribution manifold, the ink distribution manifold being connected to the ink supply reservoir at a first end of the ink distribution manifold via a third fluid conduit.

10. An inkjet printer according to claim 9, wherein the first fluid conduit connects the sump to the ink distribution manifold at a second end of the ink distribution manifold opposite the first end.

* * * * *